US009116451B2

(12) United States Patent
Nauka et al.

(10) Patent No.: US 9,116,451 B2
(45) Date of Patent: Aug. 25, 2015

(54) COATING FOR EXTENDING LIFETIME OF AN ORGANIC PHOTOCONDUCTOR

(75) Inventors: Krzystof Nauka, Palo Alto, CA (US); Zhang-Lin Zhou, Palo Alto, CA (US); Lihua Zhao, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/000,642

(22) PCT Filed: Feb. 24, 2011

(86) PCT No.: PCT/US2011/026090

§ 371 (c)(1),
(2), (4) Date: Sep. 11, 2013

(87) PCT Pub. No.: WO2012/011650

PCT Pub. Date: Aug. 30, 2012

(65) Prior Publication Data

US 2013/0344425 A1 Dec. 26, 2013

(51) Int. Cl.
*G03G 5/14* (2006.01)
*G03G 5/147* (2006.01)

(52) U.S. Cl.
CPC ..... *G03G 5/14769* (2013.01); *G03G 5/14734* (2013.01); *G03G 5/14791* (2013.01); *G03G 5/14795* (2013.01)

(58) Field of Classification Search
CPC ..... G03G 5/14704; G03G 5/14791; G03G 5/14708; G03G 5/0525; G03G 5/047; G03G 5/08; G03G 6/071
USPC ..... 430/66, 130, 132
See application file for complete search history.

(56) References Cited

U.S. PATENT DOCUMENTS

| | | | |
|---|---|---|---|
| 4,990,418 | A | 2/1991 | Mukoh et al. |
| 5,476,604 | A | 12/1995 | Nguyen et al. |
| 5,882,814 | A | 3/1999 | Fuller et al. |
| 6,068,957 | A | 5/2000 | Nair et al. |
| 6,326,111 | B1 | 12/2001 | Chambers et al. |
| 6,830,858 | B2 | 12/2004 | Sugino et al. |
| 6,902,857 | B2 | 6/2005 | Yagi et al. |
| 7,115,346 | B2 | 10/2006 | Saburo et al. |
| 7,122,283 | B2 | 10/2006 | Qi et al. |

(Continued)

FOREIGN PATENT DOCUMENTS

| | | |
|---|---|---|
| EP | 2028549 | 2/2009 |
| JP | H08262779 | 10/1996 |

(Continued)

OTHER PUBLICATIONS

International Searching Authority, "International Search Report and Written Opinion," issued in connection with PCT Application No. PCT/US11/026090, mailed on Jan. 16, 2012 (8 pages).

(Continued)

*Primary Examiner* — Hoa V Le
(74) *Attorney, Agent, or Firm* — HP Legal Department

(57) ABSTRACT

A doped protective coating for extending a lifetime of an organic photoconductor is provided. The coating includes an in-situ cross-linked polymer matrix and a substantially uniformly distributed dopant therein. The dopant comprises a charge transport molecular species. A process for coating the organic photoconductor and a coated organic photoconductor are also disclosed.

13 Claims, 2 Drawing Sheets

(56) References Cited

U.S. PATENT DOCUMENTS

| | | | | |
|---|---|---|---|---|
| 7,132,208 | B2 | 11/2006 | Lee et al. | |
| 7,361,438 | B2 | 4/2008 | Suzuki et al. | |
| 7,413,835 | B2 | 8/2008 | Lin et al. | |
| 7,645,555 | B2 | 1/2010 | Lin et al. | |
| 7,691,931 | B2 | 4/2010 | Li et al. | |
| 7,709,168 | B2 | 5/2010 | Wu et al. | |
| 8,101,320 | B2 | 1/2012 | Tong et al. | |
| 2004/0048177 | A1* | 3/2004 | Tamoto et al. | 430/58.2 |
| 2005/0238989 | A1 | 10/2005 | Kakui et al. | |
| 2005/0287452 | A1 | 12/2005 | Tamura et al. | |
| 2005/0287465 | A1 | 12/2005 | Ohshima et al. | |
| 2006/0286473 | A1 | 12/2006 | Kami | |
| 2007/0042281 | A1 | 2/2007 | Orito et al. | |
| 2007/0117033 | A1 | 5/2007 | Sugino et al. | |
| 2009/0035672 | A1 | 2/2009 | Yanagawa et al. | |
| 2009/0047588 | A1 | 2/2009 | Yanus et al. | |
| 2009/0053637 | A1 | 2/2009 | Lin et al. | |
| 2009/0092914 | A1 | 4/2009 | Wu et al. | |
| 2009/0148182 | A1 | 6/2009 | Watanabe et al. | |
| 2010/0167193 | A1 | 7/2010 | Nukada et al. | |
| 2010/0215405 | A1 | 8/2010 | Patton et al. | |
| 2010/0260513 | A1 | 10/2010 | Kawasaki et al. | |
| 2010/0297543 | A1 | 11/2010 | Tong et al. | |
| 2011/0039197 | A1 | 2/2011 | Fujita et al. | |
| 2012/0003008 | A1 | 1/2012 | Nauka et al. | |
| 2013/0288171 | A1 | 10/2013 | Ganapathiappan et al. | |

FOREIGN PATENT DOCUMENTS

| | | |
|---|---|---|
| JP | 9006035 | 1/1997 |
| JP | 09034151 | 2/1997 |
| JP | 2002311612 | 10/2002 |
| WO | WO-2010104513 | 9/2010 |
| WO | WO-2012115650 | 8/2012 |
| WO | WO-2013147864 | 10/2013 |

OTHER PUBLICATIONS

PCT Patent Application, Serial No. PCT/US12/031559, filed on Mar. 30, 2012 (unpublished).

U.S. Appl. No. 13/459,838, filed Apr. 30, 2012 (unpublished).

* cited by examiner

COATING FOR EXTENDING LIFETIME OF AN ORGANIC PHOTOCONDUCTOR

BACKGROUND

An organic photoconductor (OPC) is one of the key components of an electrophotographic (EP) process employed in many printing devices. Its lifetime is limited by the occurrence of defects introduced by mechanical and electrical interactions between the organic photoconductor (OPC) and the printing environment. The appearance of these defects can be further accelerated by interactions between the OPC and printing solvent (e.g., an isoparaffinic-based imaging oil in the case of an electrophotographic printing process). An inherent mechanical weakness of an organic material causes that OPC is one of the most frequently replaced printer component, which deleteriously impacts overall printing cost and financial bottom line of the printing provider. This shortcoming is particularly critical in the case of high speed digital printing that relies on minimizing printing costs in order to successfully compete with the analog printing. Previous attempts of replacing the OPC with an inorganic photoconductor or coating OPC with a hard inorganic protective layer have mostly failed due to excessive cost, manufacturing problems or poor performance of the resulting product.

For example, attempts to improve the mechanical strength of the OPC surface region have relied on coating it with a layer of inorganic, "hard" material, such as carbon (diamond), silica, etc. The coating is usually produced via a sputtering or sol-gel process. However, the coating suffers from a number of problems, including adhesion to the OPC, damage caused to the OPC during deposition, and mechanical wear-out when extensively used, producing excessive amounts of particles. Several attempts of coating the OPC with polymerized materials (such as by sputtering or deposition from a solvent) have also failed due to OPC damage, poor adhesion or excessive electrical resistivity of the coating.

DETAILED DESCRIPTION

Figure 1:
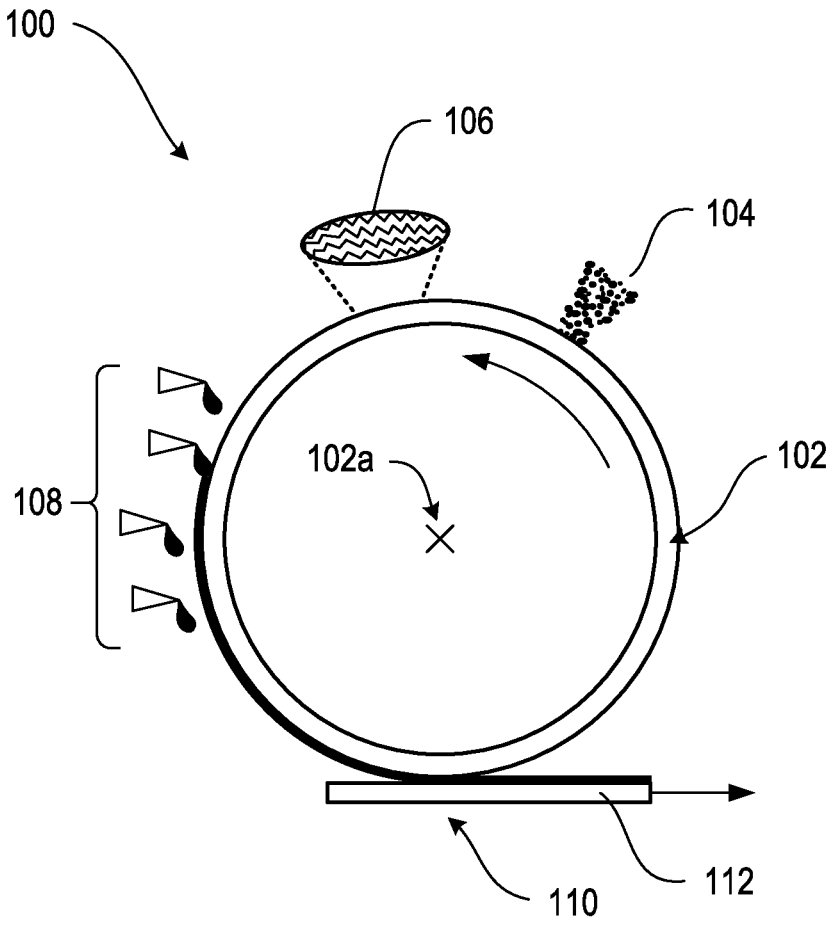
FIG. 1 is a schematic diagram of an apparatus that employs an example organic photoconductor drum, in accordance with the teachings herein.

Reference is made now in detail to specific examples, which illustrate the best mode presently contemplated by the inventors for practicing the various aspects of the invention. Alternative examples are also briefly described as applicable.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is noted that, as used in this specification and the appended claims, the singular forms "a," "an," and "the" include plural referents unless the context clearly dictates otherwise.

As used herein, "alkyl" refers to a branched, unbranched, or cyclic saturated hydrocarbon group, which typically, although not necessarily, includes from 1 to 50 carbon atoms, or 1 to 30 carbon atoms, or 1 to 6 carbons, for example. Alkyls include, but are not limited to, methyl, ethyl, n-propyl, isopropyl, n-butyl, isobutyl, t-butyl, octyl, and decyl, for example, as well as cycloalkyl groups such as cyclopentyl, and cyclohexyl, for example.

As used herein, "aryl" refers to a group including a single aromatic ring or multiple aromatic rings that are fused together, directly linked, or indirectly linked (such that the different aromatic rings are bound to a common group such as a methylene or ethylene moiety). Aryl groups described herein may include, but are not limited to, from 5 to about 50 carbon atoms, or 5 to about 40 carbon atoms, or 5 to 30 carbon atoms or more. Aryl groups include, for example, phenyl, naphthyl, anthryl, phenanthryl, biphenyl, diphenylether, diphenylamine, and benzophenone. The term "substituted aryl" refers to an aryl group comprising one or more substituent groups. The term "heteroaryl" refers to an aryl group in which at least one carbon atom is replaced with a heteroatom. If not otherwise indicated, the term "aryl" includes unsubstituted aryl, substituted aryl, and heteroaryl.

As used herein, "substituted" means that a hydrogen atom of a compound or moiety is replaced by another atom such as a carbon atom or a heteroatom, which is part of a group referred to as a substituent. Substituents include, but are not limited to, for example, alkyl, alkoxy, aryl, aryloxy, alkenyl, alkenoxy, alkynyl, alkynoxy, thioalkyl, thioalkenyl, thioalkynyl, and thioaryl.

The terms "halo" and "halogen" refer to a fluoro, chloro, bromo, or iodo substituent.

As used herein, "alcohol" means a lower alkyl chain alcohol, such as methanol, ethanol, n-propanol, iso-propanol, n-butanol, iso-butanol, tert-butanol, pentanol, hexanol, and their analogs.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

As mentioned above, the lifetime of the organic photoconductor (OPC) is limited by the occurrence of defects introduced by mechanical and electrical interactions between the organic photoconductor (OPC) and the printing environment.

In accordance with the teachings herein, the OPC may be coated with a mechanically resistant cross-linkable polymer film having controlled electrical properties. Coated OPCs were tested and showed a significant improvement of damage resistance while maintaining high print quality. This cost-effective solution avoids problems introduced by coating it with a layer of inorganic, "hard" material, such as carbon (diamond), silica, etc. when trying to improve the mechanical strength of the OPC surface region.

A cross-linked surface film of tri- or bi-functional monomers and mono-functional monomers of charge transport materials (CTMs) is known. However, the process for achieving such a film requires modifying the CTMs themselves with polymerizable functional groups, which is expensive to do and unstable to maintain. Herein, CTMs are used without polymerizable groups, but are still able to achieve the needed electrical properties, which also provides great flexibility to the selection of CTMs. This is done by mixing a cross-linkable composition and CTMs in a common solvent or mixture of solvents and cross-linking the composition, which is a more universal and much lower cost process.

The protective coating disclosed herein includes at least one cross-linked polymer matrix and a substantially uniformly distributed dopant therein, the dopant comprising a charge transport molecular species (CTM). In particular, the doped protective coating is formed from a matrix polymer species that is deposited and subsequently cross-linked. The matrix polymer species comprises a monomer, an oligomer and/or a functionalized polymer, the dopant, an initiator, a cross-linker, and a solvent in which both the matrix polymer species and the dopant are soluble.

The protective coating disclose here may also include additional species in form of organic or inorganic nanoparticles, the role of which is to enhance mechanical strength and resistance to mechanical damage during the normal press operation. These particles may be surface functionalized to provide their uniform distribution within the coating.

In other words, the OPC is coated with a solvent-based mixture containing monomer, oligomer and/or functionalized polymer moieties which are cross-linked after depositing on the OPC. This approach provides much better adhesion and higher mechanical strength layers than in the case when a pre-formed polymer is deposited on the OPC.

An organic photoconductor commonly used in electrophotographic applications is a dual layer structure consisting of a relatively thin (0.1 to 2 μm) bottom charge generation layer (CGL) and a relatively thick (about 20 μm) top charge transport layer (CTL). Light passes through the transparent CTL and strikes the CGL, resulting in the generation of free electrons and holes. Electrons are collected by the electrical ground of the photoreceptor and holes are driven by the applied electrical field towards the top of the CTL by a hopping mechanism.

The CTL provides a mechanism for hole transport towards the surface, at which the holes are used to neutralize negative surface ions deposited during the pre-charging process. In essence, the CTL consists of a non-conductive organic material (usually a polymer) matrix with charge transport materials embedded into it. In most cases, the CTL is made of a non-conductive polycarbonate matrix having charge transport materials in form of conductive organic small molecules or short chain polymers such as aryl hydrazones, aminoaryl heterocycles such as oxadiazole, and highly conjugated arylamines.

The OPC within an electrophotographic printer is a thin film photoconductive layer. An electrostatic latent image is formed on the pre-charged photoreceptor surface via image-wide optical exposure. A visual image is obtained after the electrostatic image is developed with charged color toner particles that are subsequently transferred to a paper. After the toner transfer, the photoreceptor needs to be cleaned abrasively and corona charged with ions to get ready for the next imaging process.

An example of an electrophotographic printer that may employ the OPC is depicted in FIG. 1, which is a schematic diagram of portion of a generic EP printer. An EP printer 100 comprises an OPC drum 102 that is rotatable about an axis 102*a*. The construction of the OPC drum 102 is described in greater detail below.

As the OPC drum 102 rotates, it passes through several stations, including a charging station 104, an exposure station 106, a development station 108, and a transfer station 110.

At the charging station 104, an electrostatic charge is uniformly distributed over the surface of the OPC drum 102. Charging is typically done by a corona or a charge roller.

At the exposure station 106, also known as the image-forming station, the document to be printed or its image formed on a screen is illuminated and either passed over a lens or is scanned by a moving light and lens, such that its image is projected onto and synchronized with the moving drum surface. Where there is text or image on the document, the corresponding area of the drum remains unlit. Where there is no image, the drum is illuminated and the charge is dissipated. The charge that remains on the drum after this exposure is a "latent" image and is a negative of the original document.

At the development station 108, the drum 102 is presented with toner, e.g., liquid ink, more specifically, black ink in the case of a black ink-only printer and colored inks in the case of a color ink printer. The liquid ink is electrically charged and attracted to areas on the drum bearing complementary electrical charges.

At the transfer station 110, the ink on the drum 102 is transferred to a print medium 112, moving in the direction indicated by arrow A.

Following ink transfer, the drum 102 is prepared for a new imaging cycle.

In the electrophotographic process, the photoreceptor (web or cylinder) is required to have very uniform area characteristics, such as: coating uniformity, dark conductivity, and photoconductivity. During each imaging cycle, the OPC surface is subjected to a number of punishing electrochemical and mechanical processes. These include corrosive ozone and acid treatments from corona or charge roller charging, abrasive mechanical treatments from toner development, toner transfer to a paper, and doctor blade cleaning of the drum and contact with a charge roller. These processes may cause removal of the top part of the CTL, mechanical damage (scratching), and local cracking of the CTL. In the case of liquid electrophotography, these processes can be further enhanced by interactions between the solvent (usually a non-polar, isoparaffinic-based mixture) and the polymer constituting the CTL. In many cases, solvent penetrates into the CTL through openings caused by the mechanically damaged surface and causes local swelling of the CTL. The CTL damage degrades print quality, causing the OPC to be frequently replaced. Frequent photoconductor replacement can have a negative impact on the cost of the printing process, which is particularly important for high speed/large volume printing applications, as in the case of digital commercial printers.

Figure 2A:
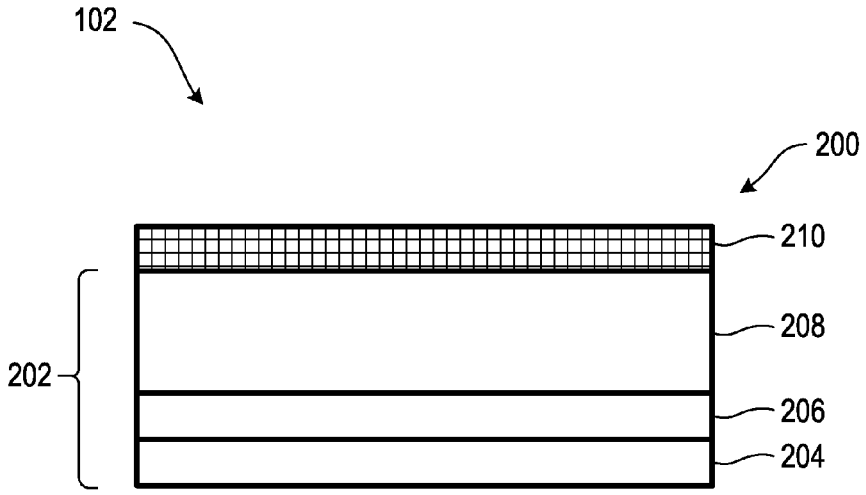
FIG. 2A is an enlargement of a portion of the organic photoconductor drum shown in FIG. 1, depicting an example configuration.
Figure 2B:
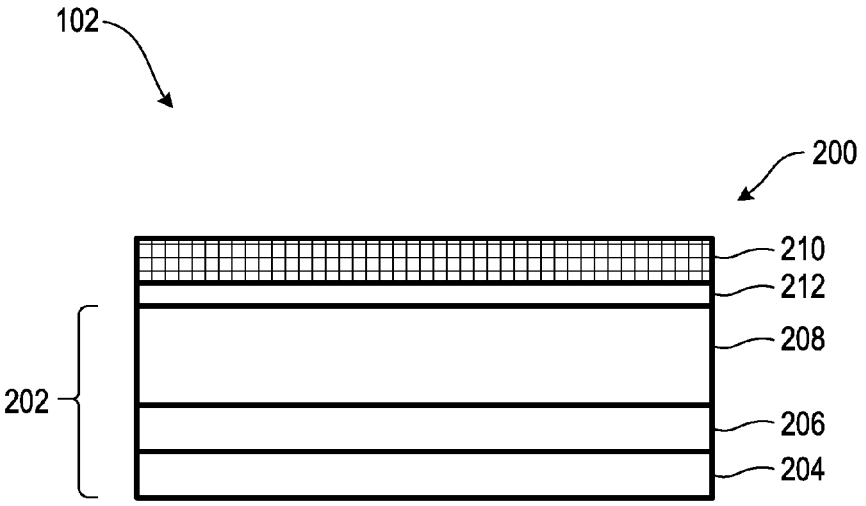
FIG. 2B is an enlargement of a portion of the organic photoconductor drum shown in FIG. 1, depicting another example configuration.

FIGS. 2A-2B depict two example configurations of a coated OPC 200. In both Figures, a conventional OPC 202 comprises a conductive substrate 204, a charge generation layer (CGL) 206, and a charge transport layer (CTL) 208. The thickness of the CTL 208 may be greater than 10 μm.

The conductive substrate 204 is one that is electrically conductive and may be transparent or opaque. Examples include thin metal films, metal-coated plastic films, ITO (indium tin oxide)-coated PET (polyethylene terephthalate), carbon nanotube mesh, conductive organic films, and the like.

The CGL 206 may comprise a variety of organic pigments such as polyazo compounds and their analogs, perylene tetracarboxydiimides and their analogs, polycyclic quinones and their analogs, phthalocyanines, and squariliums. Pigments of high crystallinity are used in the CGL to avoid crystal defects, which can otherwise trap the positive holes and hinder their transport to the interface. The pigments used in the CGL may be extremely pure and possess the correct morphology; otherwise, their performance may be impaired. For example, traces of impurities can deteriorate the photoconductive characteristics of a compound. In some cases, the pigments may be purified by sublimation. The crystallinity of a pigment and its particle size may be important parameters in determining OPC performance.

The CTL 208 may comprise charge transport materials, which include any p-type semiconductors, such as aryl hydrazone and their substituted analogs, aminoaryl oxadiazole and their substituted analogs, aromatic amines, aromatic amine-based oligomers, and aromatic amine-based polymers and co-polymers. In some examples, sterically-hindered aromatic amines may be used. A good CTL material may have good charge mobility and environmental stability, especially to light and atmospheric oxidation.

In accordance with the teachings herein, the CTL 208 may be coated with a protective film having superior resistance against printing damage. This protective film may possess electrical properties providing the normal operation of the CTL. A process of coating the photoconductor with a layer consisting of mechanically "strong" polymer with uniformly embedded charge transport moieties is disclosed herein, using a liquid solvent mixture of monomers, oligomers or even functionalized polymers (called herein "matrix polymer species") mixed with miscible charge transport molecular species. The mixture may also include other moieties (e.g., initiator and cross-linker) providing cross-linking of the aforementioned monomer, oligomer and polymer species when activated. In addition, the mixture may include surfactants (to improve wetting) and other species providing advantageous properties to the final product (for example, "hard" inorganic nanoparticles or "very strong" polymer(s) providing additional resistance against mechanical damage).

For example, scratch resistance can be quantified in terms of hardness parameters (hardness Rockwell parameter [R] or hardness Shore parameter [D]). The afore-described coating materials (after cross-linking) are expected to have R parameter from the range of 100 to 180 and D parameter from the range of 85 to 150 in the case of polymers without inorganic additive particles. Cross-linked coating films containing "hard" inorganic nanoparticles (e.g., silica, with particle size below 500 nm and a particle load of up to 0.5% of the polymer-inorganic particle mixture) are expected to have R parameter in excess of 180.

Alternatively, coating layer moieties that are cross-linked may be selected not on the basis of their increased mechanical strength as compared to the original CTL matrix material but rather on their ability not to react with the solvent during the printing process. Since the present photoconductor lifetime degradation is primarily due to surface mechanical damage followed by solvent penetration through damage regions into the CTL and swelling of the CTL-caused interaction between the solvent and the CTL, one may tolerate mechanical damage to the coating material as long as coating does not react with the solvent. In other words, one may achieve an extended photoconductor lifetime not by pre-venting surface damage but rather by selecting coating layer materials that do not interact with the solvent (assuming that coating is thick enough that mechanical damage does not penetrate into the underlying CTL). Examples of such coating (mechanically "soft" but not reacting with the solvent used in printing process) include, but are not limited to, nylon, polystyrene, polypropylene, teflon, and selected polyurethanes.

Alternatively, coating layer cross-linkable moieties can be selected to provide both the above-described functions, namely, high mechanical strength and lack of reaction with solvent used in printing process.

In an example configuration, shown in FIG. 2A, the conventional OPC 202 is provided with a doped protective coating (DPC) 210. In this case, the DPC 210 is applied to the surface of the CTL 208 using a solvent that the CTL material is insoluble in, as described in greater detail below. The thickness of the DCP 210 in this example may be less than 2 μm.

In another example configuration, shown in FIG. 2B, the conventional OPC 202 is also provided with the DPC 210, but using a solvent that the CTL material of the CTL 208 is at least partially soluble in. The use of such a solvent forms a transition layer 212 between the CTL 208 and the DPC 210, comprising a mixture of the CTL and DPC materials. The thickness of the DPC 210 in this example may be less than 2 μm.

The liquid mixture is then applied to the OPC, forming a thin, substantially uniform coating (with the help of one or more surfactants), and the solvent is allowed to evaporate. In some examples, the coating may be less than about 2 μm), while in other examples, somewhat thicker coatings with a high enough electrical conductivity and charge mobility may be employed. Finally, the polymerizable components of the liquid mixture are cross-linked, forming a strong, mechanically conformal protective coating consisting of a polymer thin layer matrix with a uniformly distributed added species (charge transport moieties, nanoparticles, mechanically "very strong" polymer molecules, etc.).

There are various methods in which the surface of OPC may be covered with a thin layer of a mechanically-resistant, cross-linked polymer with a hole-transport material embedded into it. This may be accomplished by coating the OPC with a thin film liquid formulation including a monomer, a hole-transport material (dopant), an initiator, a cross-linker, and wetting agents, including solvent. For example, the liquid formulation may be sprayed onto the surface of OPC and a blade, such as a plastic blade, may be used to achieve the desired uniform thickness of the liquid film. Alternatively, a uniformly thick liquid layer may be applied with a roller.

After solvent evaporation, the monomer coating may be polymerized by applying heat or low intensity UV illumination, depending on the type of initiator used.

Alternatively, polymerization may be accomplished by mounting the photoconductor in a press and commencing printing. Heat and UV exposure during the printing process (especially in the case of using a charge roller that produces copious amounts of UV radiation) is sufficient to complete polymerization within the first few tens to hundreds of printed pages.

Combination of partial polymerization before mounting the photoconductor in a press followed by continuation of the polymerization during press operation can also be used.

In any event, the polymerization may be performed in air or in an inert ambient environment.

Controlled polymerization (by varying time, UV exposure or temperature) can be used to tune the mechanical strength of a protective layer. Further control of this parameter can be achieved by introducing additional mechanically resistant additives into deposited liquid formulation. Desired electrical conductivity within the protective film can be achieved by detailed control of the monomer-to-hole transport material ratio in the mixture. Choice of solvent partially attacking the photoconductor (for example, toluene) can result in partial mixing of the protective film and underlying photoconductor without degradation of the photoconductor's properties (FIG. 2B). Alternatively, choice of a solvent more neutral to photoconductor (for example, an isoparaffinic solvent) may prevent their mixing (FIG. 2A).

Precise control of the layer thickness is achieved by adjusting the solvent-to-matrix polymer species ratio in the mixture before deposition with a given coating technique (for a given thickness of the deposited liquid film, a higher solvent-to-polymer ratio means thinner final coating). The polymer concentration may be in a range of about 0.1 to 10 wt % in some examples and about 0.25 to 2 wt % in other examples. Similarly, a larger ratio of the charge transport materials to the matrix polymer species results in a higher electrical conductivity of the final coating. The dopant (charge transport material) concentration in the solvent may be in a range of about 0.05 to 0.5 wt % in some examples and about 0.075 to 0.25 wt % in other examples.

The cross-linked inert polymer network may be formed by using a mixture of cross-linkable monomer, oligomers, and polymers, in addition to cross-linking agent and an initiator. The cross-linking agent may be a 2-branch, 3-branch, or 4-branch cross-linker, for examples, diacrylates, triacrylates, tetraacrylates, divinylstylenes, diisocyanates, ethylene glycols and the like, that can be initiated with appropriate energy.

The liquid solvent mixture may include at least one monomer, which may include any of multifunctional acrylates, styrene, divinyl benzene, iso-cyanates, and di-iso-cyanates. Examples of multifunctional acrylates include diacrylates, triacrylates, tetraacrylates, and the like. The liquid solvent mixture may include at least one oligomer. For example, acrylate oligomer CN2930, polyester acrylate oligomer CN2302, acrylated polyester oligomer CN299, difunctional polyether methacrylates, etc. The liquid solvent mixture may include at least one functional polymer. Examples include polyester acrylates and polyethylene glycol acrylates. The liquid mixture may alternatively include at least one oligomer or at least one functionalized polymer. By a "functionalized polymer" is a polymer that can be cross-linked with a cross-linking agent (cross-linker).

The liquid solvent mixture further may include at least one dopant, which may be any of the aromatic amines described above. Such amines serve as hole transport moieties. The concentration of the dopant in the monomer mixture is a balance between a minimum concentration to provide hole transport and a maximum concentration to retain mechanical strength. Consistent with these considerations, the dopant concentration may be within the range of about 0.01 to 0.5 wt %.

The liquid solvent mixture further may include at least one cross-linker. The cross-linker may be two-branch, meaning the molecule has two functionalities, or three-branch, meaning the molecule has three functionalities, or four-branch, meaning the molecule has four functionalities. Examples of suitable initiators include both thermal and photo initiators. The concentration of the cross-linker in the liquid solvent mixture may be within the range of about 2 to 50 wt %.

The liquid solvent mixture further may include at least one initiator which may be activated by photo or thermal energy. Examples of suitable thermal initiators include organic peroxides, azo compounds and inorganic peroxides. Illustrative examples of organic peroxides include diacyl peroxide, peroxycarbonate, and peroxyester. In some examples, the organic peroxide may be a radical initiator such as isobutyl peroxide, lauroyl peroxide, stearyl peroxide, succinic acid peroxide, di-n-propyl peroxydicarbonate, diisopropyl peroxydicarbonate, or bis(4-tert-butylcyclohexyl)peroxy-dicarbonate. Examples of the inorganic initiators may include ammonium persulfate, sodium persulfate, and potassium persulfate. Combinations of two or more of the above may also be employed.

Examples of suitable photo initiators include 2,4,6-trimethyl-benzoyldiphenylphosphine oxide (available as BASF Lucirin TPO), 2,4,6-trimethyl-benzoylethoxyphenylphosphine oxide (available as BASF Lucirin TPO-L), bis(2,4,6-trimethylbenzoyl)-phenyl-phosphine oxide (available as Ciba IRGACURE 819) and other acyl phosphines, 2-benzyl 2-dimethylamino 1-(4-morpholinophenyl) butanone-1 (available as Ciba IRGACURE 369), titanocenes, and isopropylthioxanthone, 1-hydroxy-cyclohexylphenylketone, benzophenone, 2,4,6-trimethylbenzophenone, 4-methyl-benzophenone, 2-methyl-1-(4-methylthio)phenyl-2-(4-morphorlinyl)-1-propanone, diphenyl-(2,4,6-trimethylbenzoyl)phosphine oxide, 2,4,6-trimethylbenzoylphenyl-phosphinic acid ethyl ester, oligo-(2-hydroxy-2-methyl-1-(4-(1-methylvinyl)phenyl) propanone), 2-hydroxy-2-methyl-1-phenyl-1-propanone, benzyl-dimethylketal, t-butoxy-3,5,3-trimethylhexane, benzophenone, 2-hydroxy-2-methyl-1-phenyl-1-propanone, anisoin, benzil, camphorquinone, 1-hydroxycyclohexylphenyl ketone, 2-benzyl-2-dimethylamino-1-(4-morph-olinophenyl)-butan-1-one, 2,2-dimethoxy-2-phenylacetophenone, 2-methyl-1-[4-(methylthio)phenyl]-2-(4-morpholinyl)-1-propanone, and mixtures or two or more of the above. Also included are amine synergists such as, for example, ethyl-4-dimethylaminobenzoate and 2-ethylhexyl-4-dimethylamino benzoate. This list is not exhaustive and any known photopolymerization initiator that initiates a free radical reaction upon exposure to a desired wavelength of radiation such as UV light may be used. Combinations of one or more of the above may also be employed in some examples.

In some examples, the multifunctional acrylates may include a portion or moiety that functions as a polymer precursor as described herein-below. Examples of multifunctional acrylate monomers or oligomers that may be employed as the polyfunctional cross-linking agent (some of which include a polymer precursor moiety) in the present embodiments, by way of illustration and not limitation, include diacrylates such as propoxylated neopentyl glycol diacrylate (Sartomer SR 9003, available from Atofina Chemicals, Inc. (Philadelphia Pa.)), 1,6-hexanediol diacrylate (Sartomer SR 238 available from Sartomer Company, Inc., (Exton, Pa.)), tripropylene glycol diacrylate, dipropylene glycol diacrylate, aliphatic diacrylate oligomer (CN 132 from Atofina), aliphatic urethane diacrylate (CN 981 from Atofina), and aromatic urethane diacrylate (CN 976 from Atofina), triacrylates or higher functionality monomers or oligomers such as amine modified polyether acrylates (available as PO 83 F, LR 8869, or LR 8889 from BASF Corporation), trimethylol propane triacrylate (Sartomer SR 351), tris(2-hydroxy ethyl) isocyanurate triacrylate (Sartomer SR 368), aromatic urethane triacrylate (CN 970 from Atofina), dipentaerythritol penta-/hexa-acrylate, pentaerythritol tetraacrylate (Sartomer SR 295), ethoxylated pentaerythritol tetraacrylate (Sartomer SR 494), and dipentaerythritol pentaacrylate (Sartomer SR 399), or mixtures of any of the foregoing. Additional examples of suitable cross-linking additives include chlorinated polyester acrylate (Sartomer CN 2100), amine modified epoxy acrylate (Sartomer CN 2100), aromatic urethane acrylate (Sartomer CN 2901), and polyurethane acrylate (Laromer LR 8949 from BASF). Other examples of polyfunctional cross-linking agents include, for example, end-capped acrylate moieties present on such oligomers as epoxy-acrylates, polyester-acrylates, acrylate oligomers, polyether acrylates, polyether-urethane acrylates, polyester-urethane acrylates, and polyurethanes end-capped with acrylate moieties such as hydroxyethyl acrylate. Further, the polyurethane oligomer can be prepared utilizing an aliphatic diisocyanate such as hexamethylene diisocyanate, cyclohexane diisocyanate, diisocyclohexylmethane diisocyanate, or isophorone diisocyanate, for example. Other examples include isophorone diisocyanate, polyester polyurethane prepared from adipic acid and neopentyl glycol, for example. Specific examples of polyfunctional cross-linking agents that include isocyanate functionalities and acrylate functionalities include materials said by Sartomer Company such as, for example, CN966-H90, CN964, CN966, CN981, CN982, CN986, Pro1154 and CN301.

The liquid solvent mixture may include at least one solvent in which the monomer(s) and dopant(s) are both soluble in. Once the monomer(s) and dopant(s) are selected, then an appropriate solvent may be selected. Examples of monomer(s), dopant(s), and solvent(s) are listed in Table I. This list is merely an example, and is not exhaustive of all possible combinations. Based on the teachings herein, a person of ordinary skill in the art can make appropriate selections of these components.

TABLE I

Examples of Monomer(s), Dopant(s), and Solvent(s).

| Monomer | Dopant | Solvent |
|---|---|---|
| N-vinylpyrrolidone, ethoxylated bisphenol A dimethylacrylate, and trimethylolpropane trimethylacrylate | polyarylamine-based hole transport material | toluene |
| N-vinylpyrrolidone, ethoxylated bisphenol A dimethylacrylate, tripropylene glycol diacrylate, and lauroyl peroxide | polyarylamine-based hole transport material | toluene |
| N-vinylpyrrolidone, aliphatic urethane diacrylate, trimethylolpropane trimethylacrylate, and diisopropyl peroxydicarbonate | polyarylamine-based hole transport material | toluene |
| N-vinylpyrrolidone, ethoxylated bisphenol A dimethylacrylate, ethoxylated pentaerythritol tetraacrylate, and bis(2,4,6-trimethylbenzoyl)-phenylphosphine oxide | polyarylamine-based hole transport material | toluene |
| N-vinylpyrrolidone, ethoxylated bisphenol A dimethylacrylate, trimethylolpropane trimethylacrylate, and 2,2-dimethoxy-2-phenylaceto-phenone | hydrazone-based hole transport material | toluene |
| N-vinylpyrrolidone, ethoxylated bisphenol A dimethylacrylate, trimethylolpropane trimethylacrylate, and 2-methyl-1-[4-(methylthio)phenyl]-2-(4-mor-pholinyl)-1-propanone | oxadiazole-based hole transport material | toluene |

Another example includes a UV or thermal-initiated cross-linking of acrylate monomers and cross-linkers. A cross-linked polyacrylate network may be formed from a co-monomer mixture comprising (a) 5 to 20 wt % of a nitrogen-containing monomer, which serves as hydrophilic monomer as well as chain propagation accelerator; (b) 20 to 80 wt % of a two-branch acrylate cross-linking monomer; (c) 5 to 20 wt % of a three-branch or four-branch cross-linking monomer to increase cross-linking density; and (d) 1 to 10% of a photo or thermal initiator.

Yet another example includes the use of a special initiator system comprising (i) a photo or thermal initiator component; and (ii) an accelerator component comprising a nitrogen-containing monomer. A similar experiment has been demonstrated in multilayer polymer light emitting devices. Examples of polyfunctional cross-linking agents, by way of illustration and not limitation, include multifunctional acrylates such as diacrylates, triacrylates, tetraacrylates, and the like.

The afore-described protective layer concept has been tested using several selected ingredients. A protective coating was deposited on an HP Indigo photoconductor (HP Indigo 5000 series OPC), cross-linked using either UV or thermal treatment and then used to print multiple pages. Its scratch resistance was determined using a commercial scratch tester and its behavior was monitored during the prolonged printing (up to 200K pages).

EXAMPLES

The following examples are used to illustrate aspects of the invention.

Example 1

Preparation of High Performance OPC Coating Formulation 1

To a 100 ml bottle were added N-vinylpyrrolidone (65 mg), ethoxylated bisphenol A dimethylacrylate (160 mg), trimethylolpropane trimethylacrylate (200 mg) and tert-butoxy-3,5,7-trimethylhexanoate (25 mg), polyarylamine-based hole transport material (60 mg), and 50 ml of toluene. The resulting mixture was sonicated for one hour. The formulation was ready for use as a high performance OPC coating.

Example 2

Preparation of High Performance OPC Coating Formulation 2

To a 100 ml bottle are added N-vinylpyrrolidone (65 mg), ethoxylated bisphenol A dimethylacrylate (160 mg), tripropylene glycol diacrylate (200 mg), lauroyl peroxide (25 mg), polyarylamine-based hole transport material (60 mg), and 50 ml of toluene. The resulting mixture is sonicated for one hour. The formulation is ready for use as a high performance OPC coating.

Example 3

Preparation of High Performance OPC Coating Formulation 3

To a 100 ml bottle are added N-vinylpyrrolidone (65 mg), aliphatic urethane diacrylate (160 mg), trimethylolpropane trimethylacrylate (200 mg), diisopropyl peroxydicarbonate (25 mg), polyarylamine-based hole transport material (60 mg), and 50 ml of toluene. The resulting mixture is sonicated for one hour. The formulation is ready for use as a high performance OPC coating.

Example 4

Preparation of High Performance OPC Coating Formulation 4

To a 100 ml bottle are added N-vinylpyrrolidone (65 mg), ethoxylated bisphenol A dimethylacrylate (160 mg), ethoxylated pentaerythritol tetraacrylate (200 mg), bis(2,4,6-trimethylbenzoyl)-phenyl-phosphine oxide (25 mg), polyarylamine-based hole transport material (60 mg), and 50 ml of toluene. The resulting mixture is sonicated for one hour. The formulation is ready for use as a high performance OPC coating.

Example 5

Preparation of High Performance OPC Coating Formulation 5

To a 100 ml bottle are added N-vinylpyrrolidone (65 mg), ethoxylated bisphenol A dimethylacrylate (160 mg), trimethylolpropane trimethylacrylate (200 mg), 2,2-dimethoxy-2-phenylacetophenone (25 mg), hydrazone-based hole transport material (60 mg), and 50 ml of toluene. The resulting mixture is sonicated for one hour. The formulation is ready for use as a high performance OPC coating.

Example 6

Preparation of High Performance OPC Coating Formulation 6

To a 100 ml bottle are added N-vinylpyrrolidone (65 mg), ethoxylated bisphenol A dimethylacrylate (160 mg), trimethylolpropane trimethylacrylate (200 mg), 2-methyl-1-[4-(methylthio)phenyl]-2-(4-morpholinyl)-1-propanone (25 mg), oxadiazole-based hole transport material (60 mg), and 50 ml of toluene. The resulting mixture is sonicated for one hour. The formulation is ready for use as a high performance OPC coating.

The mixture of Example 1 was sprayed on the photoconductor and then wiped with a blade, providing a uniform liquid coating. Then, the coating was allowed to dry and polymerized with a lamp emitting a mixture of UV-A and UV-B radiation.

A pattern of dot images was printed onto paper using an Indigo 5000 and 7000 presses, both from an uncoated OPC and a coated OPC having the protective coating as described above for Example 1. The comparison of dot images after printing 100 pages and after printing 40,000 pages showed that the coating did not degrade the print quality, that is, there was no excessive surface conductivity.

A scratch test was performed, both on an uncoated OPC and a coated OPC having the protective coating as described above for Example 1. The scratch test employed a Tauber 551 diamond point with repetitive scratching for 3 minutes. The loads employed were 10 g and 50 g. Under a 10 g load, the uncoated OPC showed visible scratches. In contrast, under even a 50 g load, the coated OPC showed no discernable scratches.

Other examples of coating the OPC were tried, using the formulation of Example 1. For example, the mixture was sprayed and allowed to dry followed by UV polymerization. In another example, the mixture was sprayed on the photoconductor, allowed to dry, and thermally polymerized in an oven using air ambient (80° C.) and an annealing time of up to 3 hrs. In this last example, wiping the freshly sprayed mixture with a blade was employed. In a variation of this last example, wiping with a blades was not employed. All of the foregoing examples of coating the OPC were successful.

What is claimed is:

1. A doped protective coating for extending a lifetime of an organic photoconductor, the coating including:

an in-situ cross-linked polymer matrix and a substantially uniformly distributed dopant therein, the dopant comprising a charge transport molecular species, and the in-situ cross-linked polymer matrix prepared in a liquid solvent mixture with a polymer concentration in a range of about 0.1 to 10 weight % and a dopant concentration in a range of about 0.05 to 0.5 weight %, wherein the coating is formed from a matrix polymer species comprising a monomer, an oligomer or a functionalized polymer, the dopant, an initiator, a cross-linker, and a solvent in which both the matrix polymer species and the dopant are soluble.

2. The doped protective coating of claim 1 wherein the monomer is selected from the group consisting of multifunctional acrylates, styrene, divinyl benzene, iso-cyanates, and di-iso-cyanates.

3. The doped protective coating of claim 1 wherein the dopant is a selected from the group consisting of aryl hydrazones and their substituted analogs, aminoaryl oxadiazoles and their substituted analogs, aromatic amines, aromatic amine-based oligomers, and aromatic amine-based polymers and co-polymers.

4. The doped protective coating of claim 1 wherein the crosslinker is selected from the group consisting of diacrylates, triacrylates, tetraacrylates, divinylstylenes, diisocyanates, and ethylene glycols.

5. The doped protective coating of claim 1 wherein the initiator either is activated by photo energy and is selected from the group consisting of photopolymerization initiators that initiate a free radical reaction upon exposure to a desired wavelength of radiation or is activated by thermal energy and is selected from the group consisting of organic peroxides, azo compounds and inorganic peroxides.

6. The doped protective coating of claim 1 wherein the organic photoconductor has a surface on which the doped protective coating is formed, the surface comprising a material that is insoluble in the solvent.

7. The doped protective coating of claim 1 wherein the organic photoconductor has a surface on which the doped protective coating is formed, the surface comprising a material that is at least partially soluble in the solvent, thereby forming a graded transition layer between the organic photoconductor and the doped protective coating.

8. A process for applying a coating to form an organic photoconductor, the coating extending the lifetime of the organic photoconductor, the process including:

providing the organic photoconductor;

forming a liquid solvent mixture including a matrix polymer species comprising a monomer, an oligomer or a functionalized polymer, a charge transport molecular species, an initiator, a cross-linker, and a solvent in which the matrix polymer species and the charge transport molecular species are both soluble, the liquid solvent mixture having a polymer concentration in a range of about 0.1 to 10 weight % and a dopant concentration in a range of about 0.05 to 0.5 weight %;

applying the liquid solvent mixture to a surface of the organic photoconductor;

allowing the solvent to evaporate; and cross-linking a polymerizable component of the matrix polymer species.

9. The process of claim 8 wherein cross-linking Is accomplished by UV exposure or by thermal treatment.

10. The process of claim 8 wherein the coating includes one or More of the following: cross-linkable moieties that provide a hardness after cross-linking of a Rockwell parameter within a range of 100 to 180 or a Shore parameter within a range of 85 to 150; additives that increase mechanical hardness that are functionalized to provide dispersibility in the solvent mixture; and coating species that are mechanically soft but do not react with a solvent used in a printing process that employs the organic photoconductor.

11. An organic photoconductor including:

a conductive substrate;

a charge generation layer formed on the conductive substrate;

a charge transport layer formed on the charge generation layer; and a doped protective coating formed on the charge transport layer, the coating comprising a cross-linked polymer matrix and a substantially uniformly distributed dopant therein, the dopant comprising a charge transport molecular species, and the doped protective coating prepared in a liquid solvent mixture with a polymer concentration in a range of about 0.1 to 10 weight % and a dopant concentration in a range of about 0.05 to 0.5 weight %, wherein the coating is formed from a matrix polymer species comprising a monomer, an oligomer or a functionalized polymer, the dopant, an initiator, a cross-linker, and a solvent in which both the matrix polymer species and the dopant are soluble.

12. The organic photoconductor of claim 11 wherein the monomer is selected from the group consisting of multifunctional acrylates, styrene, divinyl benzene, iso-cyanates, and di-iso-cyanates, wherein the dopant is an aromatic amine, wherein the cross-linker is selected from the group consisting of diacrylates, triacrylates, tetraacrylates, divinylstylenes, diisocyanates, ethylene glycols, wherein the initiator either is activated by photo energy and is selected from the group consisting of photopolymerization initiators that Initiate a free radical reaction upon exposure to a desired wavelength of radiation, or is activated by thermal energy and is selected from the group consisting of organic peroxides, azo compounds and inorganic peroxides.

13. The organic photoconductor of claim 11 wherein the organic photoconductor has a surface on which the coating is formed, and either the surface comprises a material that is insoluble in the solvent or the surface comprises a material that is at least partially soluble in the solvent, thereby forming a graded transition layer between the organic photoconductor and the coating.

* * * * *